US006417454B1

(12) United States Patent
Biebuyck

(10) Patent No.: US 6,417,454 B1
(45) Date of Patent: Jul. 9, 2002

(54) COAXIAL CABLE HAVING BIMETALLIC OUTER CONDUCTOR

(75) Inventor: Ghislain Biebuyck, Seneffe (BE)

(73) Assignee: CommScope, Inc., Hickory, NC (US)

( * ) Notice: Subject to any disclaimer, the term of this patent is extended or adjusted under 35 U.S.C. 154(b) by 0 days.

(21) Appl. No.: 09/598,508

(22) Filed: Jun. 21, 2000

(51) Int. Cl.[7] ..... H01B 7/18
(52) U.S. Cl. ..... 174/106 R
(58) Field of Search ..... 174/102 R, 106 R, 174/126.1, 125.1, 126.2, 110 F, 28, 102 A; 333/243, 236

(56) References Cited

U.S. PATENT DOCUMENTS

| | | | | |
|---|---|---|---|---|
| 2,576,163 | A | | 11/1951 | Weston et al. |
| 3,555,169 | A | | 1/1971 | Miller |
| 3,586,754 | A | | 6/1971 | Meskell, Jr. |
| 3,634,606 | A | | 1/1972 | Iyenger |
| 3,890,700 | A | | 6/1975 | Diepers et al. |
| 3,939,299 | A | | 2/1976 | Raw et al. |
| 4,010,315 | A | | 3/1977 | Mildner |
| 4,083,484 | A | | 4/1978 | Polizzano et al. |
| 4,317,003 | A | | 2/1982 | Gray |
| 4,408,089 | A | | 10/1983 | Nixon |
| 4,472,595 | A | * | 9/1984 | Fox et al. ..... 174/102 R X |
| 4,477,693 | A | | 10/1984 | Krabec et al. |
| 4,691,082 | A | | 9/1987 | Flatz et al. |
| 4,785,138 | A | | 11/1988 | Breitenbach et al. |
| 4,894,488 | A | * | 1/1990 | Gupta ..... 174/110 F X |
| 5,068,497 | A | | 11/1991 | Krieger |
| 5,146,048 | A | | 9/1992 | Yutori et al. |
| 5,210,377 | A | | 5/1993 | Kennedy et al. |
| 5,560,536 | A | | 10/1996 | Moe |
| 5,574,260 | A | | 11/1996 | Broomall et al. |
| 5,926,949 | A | | 7/1999 | Moe et al. |
| 5,946,798 | A | | 9/1999 | Buluschek |
| 5,959,245 | A | * | 9/1999 | Moe et al. ..... 174/110 F X |
| 6,201,189 | B1 | * | 3/2001 | Carlson et al. ..... 174/102 R |

* cited by examiner

*Primary Examiner*—Chau N. Nguyen
(74) *Attorney, Agent, or Firm*—Alston & Bird LLP

(57) ABSTRACT

A coaxial communications cable has a center conductor extending coaxially of the longitudinal axis of the cable with a low loss foam dielectric surrounding the inner conductor and bonded thereto. An electrically and mechanically continuous sheath surrounds the foam dielectric. The sheath is a smooth-walled longitudinally welded tube formed of a bimetallic material, which in one embodiment has an inwardly facing copper layer and an outwardly facing aluminum layer. A polymeric jacket surrounds the tubular sheath and is bonded thereto.

19 Claims, 1 Drawing Sheet

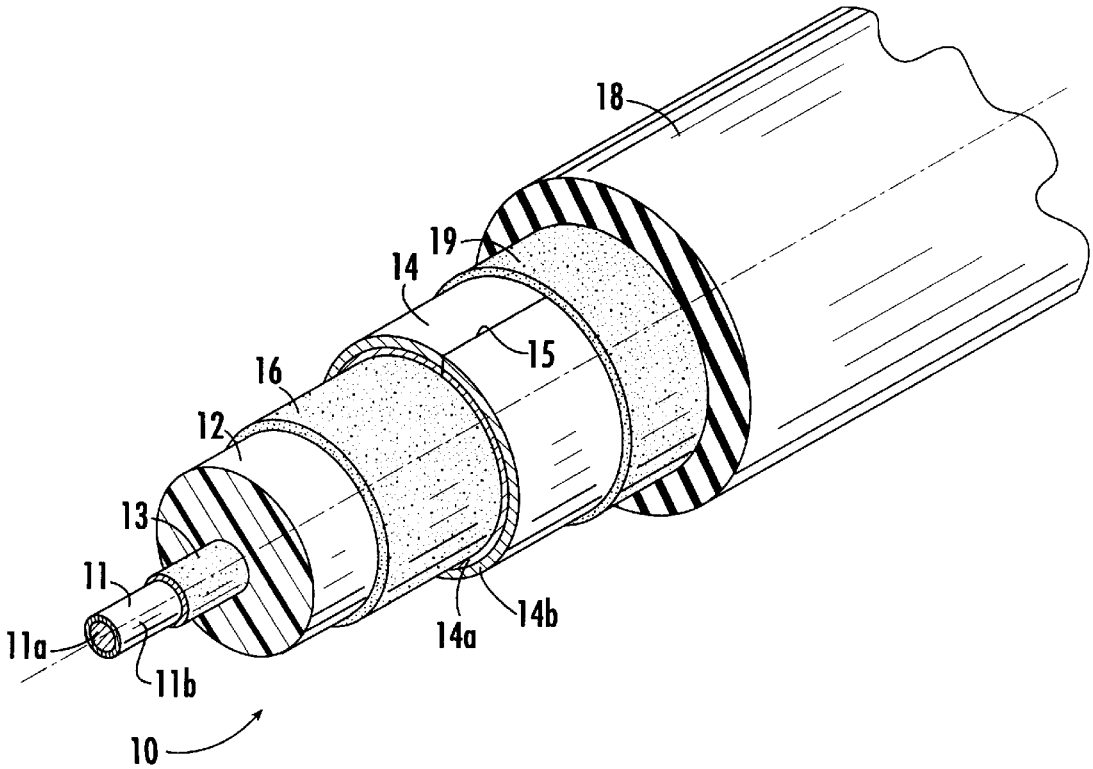
18
19
14
15
16
12
13
11
11a
11b
14a
14b
10

COAXIAL CABLE HAVING BIMETALLIC OUTER CONDUCTOR

FIELD OF THE INVENTION

The present invention relates to a coaxial cable, and more particularly to an improved low-loss coaxial cable having enhanced attenuation and mechanical bending properties.

BACKGROUND OF THE INVENTION

Coaxial cables are commonly used today in the transmission of broadband signals, such as cable television signals and cellular telephone broadcast signals, for example. One typical type of coaxial cable includes a core containing an inner conductor, an aluminum sheath surrounding the core and serving as an outer conductor, and a foam polymer dielectric which surrounds the inner conductor and electrically insulates it from the surrounding metallic sheath. A protective jacket is often provided surrounding the metallic sheath.

Coaxial cable manufacturers continue to strive to improve the electrical performance of the cable, and in particular, to lower the signal attenuation at high frequency. At the same time, any alterations in the cable design must maintain adequate mechanical characteristics, such as cable bending performance and resistance to unwanted deformation during installation, which can impair the electrical performance. U.S. Pat. No. 4,104,481 addressed these concerns by improving the composition of the foam dielectric. U.S. Pat. No. 4,472,595 provided improvements in cable performance by reducing the stiffness of the tubular sheath in relation to the stiffness of the cable core.

SUMMARY OF THE INVENTION

The present invention provides an improved cable with excellent mechanical performance and with lowered attenuation at high frequency. In accordance with the present invention, the cable uses an outer tubular sheath formed of a bimetallic material of two different metals.

The cable comprises at least one inner conductor, a foam dielectric surrounding this inner conductor, and an electrically and mechanically continuous tubular sheath formed of a bimetallic material closely surrounding the foam dielectric and being adhesively bonded thereto. The bimetallic tubular sheath includes an inwardly facing layer of a first metal bonded to the dielectric and an outwardly facing layer of a second metal different from the first metal. The inwardly facing first metal layer preferably has a lower resistivity than the outwardly facing second metal layer.

The wall thickness of the tubular metallic sheath is suitably less than about 750 micrometers and the first metal layer may have a thickness less than about 100 micrometers. In a further more specific aspect, the first metal is copper and the second metal is aluminum.

The coaxial cable may further include a protective outer jacket surrounding the sheath. Preferably, the tubular metallic sheath has a thickness of no greater than about 2.5 percent of its outer diameter.

In one specific embodiment, the coaxial communications cable comprises a center conductor extending coaxially of the longitudinal axis of the cable and formed of a copper-clad aluminum bimetallic conductor, a low loss foam dielectric surrounding the inner conductor, and an electrically and mechanically continuous smooth-walled tubular sheath formed of a bimetallic material closely surrounding said foam dielectric. The bimetallic tubular sheath includes an inwardly facing copper layer and an outwardly facing aluminum layer metallurgically bonded to the copper layer. The sheath has a wall thickness of less than 750 micrometers and the wall thickness is no greater than about 2.5 percent of its outer diameter. A thin continuous layer of adhesive is disposed between the foam dielectric and the sheath and serves to bond the foam dielectric to the inwardly facing copper layer to form a structural composite. A polymeric jacket surrounds the tubular sheath and is bonded to the outwardly facing aluminum layer.

These and other features of the present invention will become more readily apparent to those skilled in the art upon consideration of the following detailed description which describes both the preferred and alternative embodiments of the invention.

BRIEF DESCRIPTION OF THE DRAWINGS

The drawing FIGURE is a perspective view showing a coaxial cable in accordance with the present invention in cross-section and with portions of the cable broken away for purposes of clarity of illustration.

DETAILED DESCRIPTION OF THE INVENTION

The drawing illustrates a coaxial cable produced in accordance with the present invention. The coaxial cable comprises a core 10 which includes an inner conductor 11 of a suitable electrically conductive material, and a surrounding continuous cylindrical wall of expanded foam plastic dielectric material 12. Preferably, the foam dielectric 12 is adhesively bonded to the inner conductor 11 by a thin layer of adhesive 13 such that the bond between the inner conductor 11 and dielectric 12 is stronger than the dielectric material. The inner conductor 11 may be formed of solid copper, copper tubing or of copper-clad aluminum. The inner conductor 11 preferably has a smooth surface and is not corrugated. In the embodiment illustrated, only a single inner conductor 11 is shown, but it is to be understood that the present invention is applicable also to cables having more than one inner conductor insulated from one another and forming a part of the core 10. Furthermore, in the illustrated embodiment, the inner conductor 11 is a wire formed of an aluminum core 11*a* with a copper outer cladding layer 11*b*.

The dielectric 12 is a low loss dielectric formed of a suitable plastic such as polyethylene. Preferably, in order to reduce the mass of the dielectric per unit length and hence reduce the dielectric constant, the dielectric material should be of an expanded cellular foam composition, and in particular, a closed cell foam composition is preferred because of its resistance to moisture transmission. Preferably, the cells of the dielectric 12 are uniform in size and less than 200 microns in diameter. One suitable foam dielectric is an expanded high density polyethylene polymer such as described in commonly owned U.S. Pat. No. 4,104,481, issued Aug. 1, 1978. Additionally, expanded blends of high and low density polyethylene are preferred for use as the foam dielectric. The foam dielectric has a density of less than about 0.28 g/cc, preferably, less than about 0.25 g/cc.

Although the dielectric 12 of the invention generally consists of a uniform layer of foam material, the dielectric 12 may have a gradient or graduated density such that the density of the dielectric increases radially from the inner conductor 11 to the outside surface of the dielectric, either in a continuous or a step-wise fashion. For example, a foam-solid laminate dielectric can be used wherein the dielectric 12 comprises a low density foam dielectric layer surrounded by a solid dielectric layer. These constructions can be used to enhance the compressive strength and bending properties of the cable and permit reduced densities as low as 0.10 g/cc along the inner conductor 11. The lower density of the foam dielectric 12 along the inner conductor 11 enhances the velocity of RF signal propagation and reduces signal attenuation.

Closely surrounding the core is a continuous tubular smooth-walled sheath 14. The sheath 14 is characterized by being both mechanically and electrically continuous. This allows the sheath 14 to effectively serve to mechanically and electrically seal the cable against outside influences as well as to seal the cable against leakage of RF radiation. The tubular sheath 14 has a wall thickness selected so as to maintain a T/D ratio (ratio of wall thickness to outer diameter) of less than 2.5 percent. Preferably, the thickness of the bimetallic sheath 14 is less than 2.5% of its outer diameter to provide the desired bending and electrical properties of the invention. In addition, the tubular bimetallic sheath 14 is smooth-walled and not corrugated. The smooth-walled construction optimizes the geometry of the cable to reduce contact resistance and variability of the cable when connectorized and to eliminate signal leakage at the connector.

In the preferred embodiment illustrated, the tubular bimetallic sheath 14 is made from a bimetallic strip formed into a tubular configuration with the opposing side edges of the strip butted together, and with the butted edges continuously joined by a continuous longitudinal weld, indicated at 15. The welding may be carried out generally as described in U.S. Pat. Nos. 4,472,595 and 5,926,949, which are incorporated herein by reference. While production of the sheath 14 by longitudinal welding has been illustrated as preferred, persons skilled in the art will recognize that other methods for producing a mechanically and electrically continuous thin walled tubular bimetallic sheath could also be employed.

The bimetallic strip from which the sheath is formed is composed of two metal layers metallurgically bonded to one another to form a integral unitary metal strip. The two metal layers are formed of different metals having different electrical resistivities. In producing the tubular sheath, the metal layers are preferably oriented so that the lower resistivity metal layer 14*a* is inwardly facing and the higher resistivity metal layer 14*b* faces outwardly of the tubular sheath in order to improve the attenuation properties of the cable. While various different metals could be selected, in a preferred embodiment, the invention uses a bimetallic strip of copper and aluminum. The thickness of the strip is less than about 750 micrometers (desirably less than about 500 micrometers) and the copper layer has a thickness less than about 100 micrometers. Most desirably, the thickness of the copper is such that in the sheath, after fabrication and sinking onto the cable core, the copper layer has a thickness between 25 and 75 micrometers. In certain other specific applications, it may be desirable for the copper layer to be oriented outwardly, e.g. for compatibility with connectors (providing a copper-to-copper connection) or for improved mechanical performance.

The inner surface of the tubular sheath 14 is continuously bonded throughout its length and throughout its circumferential extent to the outer surface of the foam dielectric 12 by a thin layer of adhesive 16. A preferred class of adhesive for this purpose is a random copolymer of ethylene and acrylic acid (EAA). The adhesive layer 16 should be made as thin as possible so as to avoid adversely affecting the electrical characteristics of the cable. Desirably, the adhesive layer 16 should have a thickness of about 25 micrometers or less.

The outer surface of the sheath 14 is surrounded by a protective jacket 18. Suitable compositions for the outer protective jacket 18 include thermoplastic coating materials such as polyethylene, polyvinyl chloride, polyurethane and rubbers. Although the jacket 18 illustrated in FIG. 1 consists of only one layer of material, laminated multiple jacket layers may also be employed to improve toughness, strippability, burn resistance, the reduction of smoke generation, ultraviolet and weatherability resistance, protection against rodent gnaw-through, strength resistance, chemical resistance and/or cut-through resistance. In the embodiment illustrated, the protective jacket 18 is bonded to the outer surface of the sheath 14 by an adhesive layer 19 to thereby increase the bending properties of the coaxial cable. Preferably, the adhesive layer 19 is a thin layer of adhesive, such as the EAA copolymer described above. Although an adhesive layer 19 is illustrated in the drawing, the protective jacket 18 can also be directly bonded to the outer surface of the sheath 14.

The coaxial cables of the present invention are beneficially designed to limit buckling of the bimetallic sheath during bending of the cable. During bending of the cable, one side of the cable is stretched and subject to tensile stress and the opposite side of the cable is compressed and subject to compressive stress. If the core is sufficiently stiff in radial compression and the local compressive yield load of the sheath is sufficiently low, the tensioned side of the sheath will elongate by yielding in the longitudinal direction to accommodate the bending of the cable. Accordingly, the compression side of the sheath preferably shortens to allow bending of the cable. If the compression side of the sheath does not shorten, the compressive stress caused by bending the cable can result in buckling of the sheath.

The ability of the sheath to bend without buckling depends on the ability of the sheath to elongate or shorten by plastic material flow. Typically, this is not a problem on the tensioned side of the cable. On the compression side of the tube, however, the sheath will compress only if the local compressive yield load of the sheath is less than the local critical buckling load. Otherwise, the cable will be more likely to buckle thereby negatively affecting the mechanical and electrical properties of the cable.

The coaxial cables of the present invention have enhanced bending characteristics over conventional coaxial cables. One feature which enhances the bending characteristics of the cable is the use of a very thin bimetallic sheath 14. In an aluminum/copper bimetallic sheath, the relatively lower compressive yield strength of the aluminum component contributes to the avoidance of buckling failures during bending. The copper component, which has a higher compressive yield strength, is of such thinness that it does not adversely impact the overall compressive yield strength of the bimetallic sheath and the presence of the copper component of the bimetallic sheath contributes significantly to enhanced electrical performance, i.e. attenuation values. Preferably, the aluminum layer is of such a thickness as to constitute more than half, and preferably more than three-fourths of the overall cross sectional thickness of the bimetallic strip from which the sheath is formed Another feature which enhances the bending characteristics of the coaxial cable of the invention is that the sheath 14 is adhesively bonded to the foam dielectric 12 and the protective jacket 18. In this relationship, the foam dielectric 12 and the jacket 18 support the sheath 14 in bending to prevent damage to the coaxial cable. The bending characteristics of the coaxial cable are further improved by providing an adhesive layer 19 between the tubular bimetallic sheath 14 and the outer protective jacket 18.

Furthermore, increased core stiffness in relation to sheath stiffness is beneficial to the bending characteristics of the coaxial cable. Specifically, the coaxial cables of the invention have a core to sheath stiffness ratio of at least 5, and preferably of at least 10. In addition, the minimum bend radius in the coaxial cables of the invention is significantly less than 10 cable diameters, more on the order of about 7 cable diameters or lower. The reduction of the tubular sheath wall thickness is such that the ratio of the wall thickness to its outer diameter (T/D ratio) is no greater than about 2.5 percent and preferably no greater than about 1.6 percent. The reduced wall thickness of the sheath contributes to the bending properties of the coaxial cable and advantageously reduces the attenuation of RF signals in the coaxial cable. The combination of these features and the properties of the sheath 14 described above results in a cable with a unique combination of electrical performance (e.g. low attenuation values) and mechanical bending performance.

It is understood that upon reading the above description of the present invention, one skilled in the art could make changes and variations therefrom. These changes and variations are included in the spirit and scope of the following appended claims.

That which is claimed:

1. A cable comprising at least one inner conductor, a foam dielectric surrounding said at least one inner conductor, and an electrically and mechanically continuous tubular sheath formed of a bimetallic material closely surrounding said foam dielectric and being adhesively bonded thereto, said bimetallic tubular sheath including an inwardly facing copper layer bonded to said dielectric and an outwardly facing aluminum layer.

2. A cable according to claim 1 wherein said electrically and mechanically continuous tubular sheath comprises a smooth-walled longitudinally welded tube formed of said bimetallic material.

3. A cable according to claim 1, additionally including a polymer jacket surrounding said tubular sheath and bonded to said outwardly facing second metal layer.

4. A cable according to claim 1 wherein said aluminum layer is of such a thickness as to constitute more than half the overall cross sectional thickness of the bimetallic material.

5. A cable according to claim 4, wherein the wall thickness of said tubular metallic sheath is less than about 750 micrometers and said copper layer has a thickness less than 100 micrometers.

6. A cable according to claim 1 wherein said tubular bimetallic sheath has a thickness of no greater than 2.5 percent of its outer diameter.

7. A cable according to claim 1 wherein said tubular metallic sheath is adhesively bonded to said dielectric by a thin continuous adhesive layer of a thickness of about 25 micrometers or less.

8. A cable according to claim 1, wherein said at least one inner conductor comprises a copper-clad aluminum bimetallic conductor.

9. A cable according to claim 1, wherein said at least one inner conductor comprises a copper tubular member.

10. A coaxial communications cable comprising a center conductor extending coaxially of the longitudinal axis of the cable, a low loss foam dielectric surrounding the center conductor, an electrically and mechanically continuous smooth-walled tubular sheath formed of a bimetallic material closely surrounding said foam dielectric, said bimetallic tubular sheath including an inwardly facing copper layer and an outwardly facing aluminum layer metallurgically bonded to said copper layer, a thin continuous layer of adhesive disposed between said foam dielectric and said sheath and bonding the foam dielectric to said inwardly facing copper layer to form a structural composite, and a polymeric jacket surrounding said tubular sheath and bonded to said outwardly facing aluminum layer.

11. A cable according to claim 10 wherein said aluminum layer is of such a thickness as to constitute more than half the overall cross sectional thickness of the bimetallic material.

12. A cable according to claim 11, wherein the wall thickness of said tubular metallic sheath is less than 750 micrometers and said copper layer has a thickness less than 100 micrometers.

13. A cable according to claim 10 wherein said tubular bimetallic sheath has a thickness of no greater than 2.5 percent of its outer diameter.

14. A coaxial communications cable comprising a center conductor extending coaxially of the longitudinal axis of the cable and formed of a copper-clad aluminum bimetallic conductor, a low loss foam dielectric surrounding the inner conductor, an electrically and mechanically continuous smooth-walled tubular sheath formed of a bimetallic material closely surrounding said foam dielectric, said bimetallic tubular sheath including an inwardly facing copper layer and an outwardly facing aluminum layer metallurgically bonded to said copper layer, said sheath having a wall thickness of less than 500 micrometers and the wall thickness being no greater than 2.5 percent of its outer diameter, a thin continuous layer of adhesive disposed between said foam dielectric and said sheath and bonding the foam dielectric to said inwardly facing copper layer to form a structural composite, and a polymeric jacket surrounding said tubular sheath and bonded to said outwardly facing aluminum layer.

15. The coaxial cable according to claim 14 further comprising a layer of adhesive between said sheath and said protective outer jacket serving to bond the protective outer layer to the sheath.

16. A coaxial cable according to claim 14, further comprising a layer of adhesive between said center conductor and said foam dielectric serving to bond the center conductor to the dielectric.

17. A coaxial cable according to claim 14 wherein said copper layer has a thickness less than 100 micrometers.

18. A coaxial cable according to claim 17, wherein said copper layer has a thickness between 25 and 75 micrometers.

19. A coaxial communications cable comprising a center conductor extending coaxially of the longitudinal axis of the cable and formed of a copper-clad aluminum bimetallic conductor, a low loss foam dielectric surrounding the inner conductor, a layer of adhesive between said center conductor and said foam dielectric serving to bond the center conductor to the dielectric, an electrically and mechanically continuous sheath comprising a smooth-walled longitudinally welded tube formed of copper-clad aluminum closely surrounding said foam dielectric, said sheath including an inwardly facing copper layer having a thickness between 25 and 75 micrometers and an outwardly facing aluminum layer, said sheath having a wall thickness of less than 500 micrometers, a thin continuous layer of adhesive disposed between said foam dielectric and said sheath and bonding the foam dielectric to said inwardly facing copper layer to form a structural composite, a polymeric jacket surrounding said tubular sheath, and a thin layer of adhesive disposed between said sheath and said polymeric jacket and bonding said jacket to said outwardly facing aluminum layer of said sheath.

* * * * *

UNITED STATES PATENT AND TRADEMARK OFFICE

CERTIFICATE OF CORRECTION

PATENT NO. : 6,417,454 B1
DATED : July 9, 2002
INVENTOR(S) : Biebuyck

It is certified that error appears in the above-identified patent and that said Letters Patent is hereby corrected as shown below:

Title page,
Item [73], Assignee:
"CommScope, Inc., Hickory, NC (US)" should read -- CommScope Properties, LLC Sparks, NV (US) --.

Item [56], References Cited, U.S. PATENT DOCUMENTS,
"Iyenger" should read -- Iyengar --.

Column 5,
Line 44, "metallic" should read -- bimetallic --; cancel "about";
Line 51, "metallic" should read -- bimetallic --.

Column 6,
Line 10, "metallic" should read -- bimetallic --.

Signed and Sealed this

Twelfth Day of November, 2002

*Attest:*

*Attesting Officer*

JAMES E. ROGAN
*Director of the United States Patent and Trademark Office*